US009751337B2

(12) United States Patent
Steert

(10) Patent No.: US 9,751,337 B2
(45) Date of Patent: Sep. 5, 2017

(54) INKJET PRINTING OUTDOOR GRAPHICS

(71) Applicant: AGFA GRAPHICS NV, Mortsel (BE)

(72) Inventor: Koen Steert, Mortsel (BE)

(73) Assignee: AGFA GRAPHICS NV, Mortsel (BE)

( * ) Notice: Subject to any disclaimer, the term of this patent is extended or adjusted under 35 U.S.C. 154(b) by 0 days.

(21) Appl. No.: 15/304,552

(22) PCT Filed: Apr. 29, 2015

(86) PCT No.: PCT/EP2015/059283

§ 371 (c)(1),
(2) Date: Oct. 17, 2016

(87) PCT Pub. No.: WO2015/169657

PCT Pub. Date: Nov. 12, 2015

(65) Prior Publication Data

US 2017/0043593 A1 Feb. 16, 2017

(30) Foreign Application Priority Data

May 6, 2014 (EP) ..... 14167141

(51) Int. Cl.

| | |
|---|---|
| ***B41J 2/15*** | (2006.01) |
| ***B41J 11/00*** | (2006.01) |
| ***B41M 7/00*** | (2006.01) |
| ***G09F 7/00*** | (2006.01) |

(52) U.S. Cl.

CPC ..... *B41J 11/002* (2013.01); *B41M 7/0081* (2013.01); *G09F 7/00* (2013.01)

(58) Field of Classification Search

CPC ..... B41J 11/002; B41J 11/0015; B41J 2/01; B41J 2/2107; B41J 2/2114; B41J 2/2117

See application file for complete search history.

(56) References Cited

U.S. PATENT DOCUMENTS

| | | | | |
|---|---|---|---|---|
| 5,859,087 | A * | 1/1999 | Zahora | C08F 290/067 522/170 |
| 8,991,991 | B2 * | 3/2015 | Hoogmartens | C09D 11/101 347/100 |
| 9,016,850 | B1 * | 4/2015 | Pawlik | B41J 11/002 347/102 |
| 9,022,514 | B2 * | 5/2015 | Fujisawa | B41J 11/002 347/102 |
| 2002/0086914 | A1 | 7/2002 | Lee et al. | |
| 2003/0021961 | A1 | 1/2003 | Ylitalo et al. | |
| 2006/0275590 | A1 | 12/2006 | Lorenz et al. | |

FOREIGN PATENT DOCUMENTS

| | | |
|---|---|---|
| EP | 2 053 100 A1 | 4/2009 |
| EP | 1 737 892 B1 | 12/2009 |

OTHER PUBLICATIONS

Official Communication issued in International Patent Application No. PCT/EP2015/059283, mailed on Jul. 3, 2015.

* cited by examiner

*Primary Examiner* — Lamson Nguyen
(74) *Attorney, Agent, or Firm* — Keating and Bennett, LLP

(57) ABSTRACT

An inkjet printing method for producing images durable for outdoor usage includes the steps of: a) inkjet printing on a substrate a UV curable colorless primer including monofunctional monomers in a range of 40 wt % to 65 wt % based on the total weight of the UV curable colorless primer; b) at least partially UV curing the inkjet printed UV curable colorless primer; and c) inkjet printing on the at least partially cured UV curable colorless primer one or more UV curable color inkjet inks including monofunctional monomers in a range of 30 wt % to 60 wt % based on the total weight of the UV curable color inkjet inks; wherein a ratio of the wt % monofunctional monomers in the UV curable colorless primer over the wt % monofunctional monomers in the one or more UV curable color inkjet inks is between 0.65 and 2.10.

14 Claims, No Drawings

INKJET PRINTING OUTDOOR GRAPHICS

CROSS REFERENCE TO RELATED APPLICATIONS

This application is a 371 National Stage Application of PCT/EP2015/059283, filed Apr. 29, 2015. This application claims the benefit of European Application No. 14167141.2, filed May 6, 2014, which is incorporated by reference herein in its entirety.

BACKGROUND OF THE INVENTION

1. Field of the Invention

The present invention relates to inkjet printing methods for producing images durable for outdoor usage.

2. Description of the Related Art

The production of outdoor signage, advertising and promotional displays is shifting from conventional printing techniques, such as offset printing, to inkjet printing due to its capability of short run printing variable data in a economically viable way.

However, it has been observed that UV inkjet printed images over time suffer from weathering conditions, such as flaking off and fading of the image. This is induced by UV radiation from the sun causing chemical degradation; by changes in temperature and humidity causing tensile stress/fatigue stress; by airborne pollutants such as ozone, $NO_x$ and $SO_x$; by sand abrasion winds; by salt water and acid rain; and by biological factors such as mildew, algae and bird's droppings. Flaking off means that printed image comes off a substrate in flakes or thin small pieces.

US 2003021961 A (3M) disclose imaged articles that are durable for outdoor usage by ink jet printing radiation curable inks to primed substrates. The primers are coated on polymeric sheets and then inkjet printed with radiation curable inkjet inks. One example using a radiation curable primer is disclosed in [0197]-[0198]. The radiation curable primer is coated on a substrate, then radiation curable inkjet ink is jetted on the uncured primer and then both the primer and the inkjet ink are cured together.

EP 2053100 A (AGFA) discloses an inkjet printing method comprising the steps of: a) providing a first radiation curable composition curable by free radical polymerization or cationic polymerization; b) applying a layer of the first radiation curable composition on a substrate; c) curing the layer; and d) jetting on the cured layer a second composition curable by a different polymerization than the first composition but selected from the group consisting of free radical polymerization and cationic polymerization characterized in that the first composition comprises a cationically polymerizable compound having at least one (meth)acrylate group in an amount of at least 25 wt % based upon the total weight of the first curable composition.

US 2006275590 (LORENZ ET AL) discloses a method of printing a durable image on a substrate comprising the steps of: coating the treated surface with an acrylic polyurethane mixture; allowing the acrylic polyurethane coated substrate to set; and then printing a UV-cured ink design on the substrate surface.

EP 1737892 A (ASHLAND) discloses the application of radiation curable overprint varnishes for printed substrates based on multifunctional, uncrosslinked, liquid Michael addition resins to improve weather resistance.

US 2002086914 (3M) discloses radiation curable ink jet inks that are printed on a variety of porous and nonporous substrates which after curing form durable, weatherable, abrasion resistant, printed images. No information is given on light fading.

There exists still a need to provide inkjet printed images having improved weather resistance especially exhibiting improvement in flaking off, light fading, flexibility and hardness.

SUMMARY OF THE INVENTION

In order to overcome the problems described above, preferred embodiments of the present invention provide an inkjet printing method as defined below.

It was surprisingly found that by including a colourless primer between the substrate and the inkjet ink layer and controlling the amount of monofunctional monomers in the primer vis-à-vis the amount of monofunctional monomers in the inkjet ink, that an improved hardness was obtained and also light fading could be reduced to a minimum, while maintaining good results for flexibility and flaking off.

Further advantages and benefits of the invention will become apparent from the description hereinafter.

DETAILED DESCRIPTION OF THE PREFERRED EMBODIMENTS

Definitions

The term "alkyl" means all variants possible for each number of carbon atoms in the alkyl group i.e. methyl, ethyl, for three carbon atoms: n-propyl and isopropyl; for four carbon atoms: n-butyl, isobutyl and tertiary-butyl; for five carbon atoms: n-pentyl, 1,1-dimethyl-propyl, 2,2-dimethyl-propyl and 2-methyl-butyl, etc.

Unless otherwise specified a substituted or unsubstituted alkyl group is preferably a $C_1$ to $C_6$-alkyl group.

Unless otherwise specified a substituted or unsubstituted alkenyl group is preferably a $C_1$ to $C_6$-alkenyl group.

Unless otherwise specified a substituted or unsubstituted alkynyl group is preferably a $C_1$ to $C_6$-alkynyl group.

Unless otherwise specified a substituted or unsubstituted aralkyl group is preferably a phenyl or naphthyl group including one, two, three or more $C_1$ to $C_6$-alkyl groups.

Unless otherwise specified a substituted or unsubstituted alkaryl group is preferably a $C_7$ to $C_{20}$-alkyl group including a phenyl group or naphthyl group.

Unless otherwise specified a substituted or unsubstituted aryl group is preferably a phenyl group or naphthyl group Unless otherwise specified a substituted or unsubstituted heteroaryl group is preferably a five- or six-membered ring substituted by one, two or three oxygen atoms, nitrogen atoms, sulphur atoms, selenium atoms or combinations thereof.

The term "substituted", in e.g. substituted alkyl group means that the alkyl group may be substituted by other atoms than the atoms normally present in such a group, i.e. carbon and hydrogen. For example, a substituted alkyl group may include a halogen atom or a thiol group. An unsubstituted alkyl group contains only carbon and hydrogen atoms Unless otherwise specified a substituted alkyl group, a substituted alkenyl group, a substituted alkynyl group, a substituted aralkyl group, a substituted alkaryl group, a substituted aryl and a substituted heteroaryl group are preferably substituted by one or more constituents selected from the group consisting of methyl, ethyl, n-propyl, isopropyl, n-butyl, isobutyl and tertiary-butyl, ester group, amide group, ether group, thioether group, ketone group, aldehyde group, sulfoxide group, sulfone group, sulfonate ester group, sulphonamide group, —Cl, —Br, —I, —OH, —SH, —CN and —$NO_2$.

The term "image" includes text, numbers, graphics, logos, photos, barcodes, QR codes, and the like. An image can be defined in 1 or more colours.

A "colourless primer" means that no colour pigment or colour dye is present in the primer.

Inkjet Printing Methods

An inkjet printing method for producing images durable for outdoor usage according to a preferred embodiment of the invention includes the steps of: a) inkjet printing on a substrate a UV curable colourless primer including monofunctional monomers in a range of 40 wt % to 65 wt %, more preferably 50 wt % to 60 wt %, based on the total weight of the UV curable colourless primer; b) at least partially UV curing the inkjet printed UV curable colourless primer; and c) inkjet printing on the at least partially cured UV curable colourless primer one or more UV curable colour inkjet inks including monofunctional monomers in a range of 30 wt % to 60 wt %, more preferably 40 wt % to 50 wt %, based on the total weight of the UV curable colour inkjet inks; wherein a ratio of the wt % monofunctional monomers in the UV curable colourless primer over the wt % monofunctional monomers in the one or more UV curable colour inkjet inks is between 0.65 and 2.10, more preferably between 1.45 and 2.00.

In a preferred embodiment of the inkjet printing method, the absolute difference in wt % of monofunctional monomers in the UV curable colourless primer and the wt % of monofunctional monomers in the one or more UV curable colour inkjet inks is at least 8 wt %, more preferably at least 10 wt %.

In a particularly preferred embodiment, the UV curable colourless primer and the one or more UV curable colour inkjet inks are free radical curable compositions.

In a preferred embodiment of the inkjet printing method, the surface tension of the UV curable colourless primer is at least 2 mN/m larger than the surface tension of the one or more UV curable colour inkjet inks. This allows to obtain a good image quality for the colour inkjet inks on the primer.

The surface tension of the UV curable colourless primer and the inkjet inks is preferably from 20 to 50 mN/m at 25° C., more preferably from 22 to 35 mN/m at 25° C. It is preferably 20 mN/m or more from the viewpoint of printability by a second radiation curable inkjet ink, and it is preferably not more than 35 mN/m from the viewpoint of the wettability.

For having a good ejecting ability, the viscosity of the UV curable colourless primer and the inkjet inks at the jetting temperature is preferably smaller than 30 mPa·s, more preferably smaller than 15 mPa·s, and most preferably between 4 and 13 mPa·s at a shear rate of 1,000 $s^{-1}$ and at 45° C.

The inkjet printing method is advantageously used to manufacture outdoor articles having an image obtained by the inkjet printing method as defined above. The outdoor article is preferably selected from the group consisting of signage, billboards, banners, exhibition panels, construction announcements and ad panels.

UV Curable Colourless Primers

The UV curable colourless primer includes monofunctional monomers in a range of 40 wt % to 65 wt %, preferably 45 wt % to 55 wt % based on the total weight of the UV curable colourless primer. The UV curable colourless primer may include other components like polyfunctional monomers and oligomers, one or more photoinitiators, one or more co-initiators, one or more inhibitors and one or more surfactants in amounts that are desired to be jetabble and curable by inkjet printers.

In a preferred embodiment, the monofunctional monomers in the UV curable colourless primer consist of monoacrylates. Using monoacrylates instead of e.g. methacrylates and vinyllactams allows for high curing speeds.

The UV curable colourless primer preferably includes more than 6 wt %, more preferably more than 8 wt % of a phosphineoxide type photoinitiator. The phosphineoxide type photoinitiator preferably is or includes 2,4,6-trimethylbenzoyl-diphenyl-phosphineoxide. The UV curable colourless primer preferably includes no thioxanthone type photoinitiator. An advantage of these choices is that the colourless primer after curing doesn't exhibit a yellowish colour due to degradation products of a thioxanthone type photoinitiator, while high curing speed by UV LED can be obtained.

UV Curable Colour Inkjet Inks

The UV curable colour inkjet inks include monofunctional monomers in a range of 30 wt % to 60 wt %, preferably 30 wt % to 40 wt % based on the total weight of the UV curable colour inkjet inks. When the amount of monofunctional monomers in the UV curable colourless primer is in a range of 45 wt % to 55 wt % and the amount of monofunctional monomers in the UV curable colour inkjet inks is in a range of 30 wt % to 40 wt % high pencil hardness is observed, making the outdoor articles less susceptible for scratches.

The UV curable colour inkjet inks may include other components like polyfunctional monomers and oligomers, one or more photoinitiators, one or more co-initiators, one or more inhibitors and one or more surfactants in amounts that are desired to be jetabble and curable by inkjet printers.

In a preferred embodiment, the monofunctional monomers in the UV curable colour inkjet inks consist of monoacrylates. Using monoacrylates instead of e.g. methacrylates and vinyllactams allows for high curing speeds.

The one or more UV curable colour inkjet inks form a UV curable inkjet ink set, preferably a UV curable CMYK inkjet ink set.

The UV curable CMYK-inkjet ink set may also be extended with extra inks such as red, green, blue, and/or orange to further enlarge the colour gamut of the image. The UV curable inkjet ink set may also be extended by the combination of full density inkjet inks with light density inkjet inks. The combination of dark and light colour inks and/or black and grey inks improves the image quality by a lowered graininess.

The curable inkjet ink set may also include a varnish. The curable inkjet ink set preferably also includes a white inkjet ink.

The UV curable inkjet ink set is preferably a free radical curable inkjet ink set.

Colorants

The colorants used in the UV curable inkjet inks can be a combination of pigments and dyes, but preferably consist of colour pigments. Organic and/or inorganic pigments may be used.

The pigments may be black, white, cyan, magenta, yellow, red, orange, violet, blue, green, brown, mixtures thereof, and the like. A colour pigment may be chosen from those disclosed by HERBST, Willy, et al. Industrial Organic Pigments, Production, Properties, Applications. 3rd edition. Wiley-VCH, 2004. ISBN 3527305769.

Suitable pigments are disclosed in paragraphs [0128] to [0138] of WO 2008/074548 (AGFA GRAPHICS).

In a preferred embodiment, the one or more UV curable colour inkjet inks include a UV curable yellow inkjet ink including a pigment selected from the group consisting of C.I Pigment Yellow 150, C.I Pigment Yellow 151, C.I Pigment Yellow 155 and C.I Pigment Yellow 180, more preferably selected from the group consisting of C.I Pigment Yellow 151 and C.I Pigment Yellow 155. Most preferably the UV curable yellow inkjet ink includes C.I Pigment Yellow 155.

A preferred pigment for the cyan inkjet ink is C.I. Pigment Blue 15:4.

A preferred pigment for the magenta inkjet ink is a quinacridone pigment or a mixed crystal of a quinacridone pigment.

Mixed crystals are also referred to as solid solutions. For example, under certain conditions different quinacridones mix with each other to form solid solutions, which are quite different from both physical mixtures of the compounds and from the compounds themselves. In a solid solution, the molecules of the components enter into the same crystal lattice, usually, but not always, that of one of the components. The x-ray diffraction pattern of the resulting crystalline solid is characteristic of that solid and can be clearly differentiated from the pattern of a physical mixture of the same components in the same proportion. In such physical mixtures, the x-ray pattern of each of the components can be distinguished, and the disappearance of many of these lines is one of the criteria of the formation of solid solutions. A commercially available example is Cinquasia™ Magenta RT-355-D from Ciba Specialty Chemicals.

Also mixtures of pigments may be used in the UV curable colour inkjet inks. A UV curable neutral black inkjet ink is preferred and can be obtained, for example, by mixing a black pigment and a cyan pigment and/or magenta pigment into the ink.

Non-organic pigments may be used in the pigment dispersions. Particular preferred pigments are C.I. Pigment Metal 1, 2 and 3. Illustrative examples of the inorganic pigments include red iron oxide (III), cadmium red, ultramarine blue, prussian blue, chromium oxide green, cobalt green, amber, titanium black and synthetic iron black.

Pigment particles in inkjet inks should be sufficiently small to permit free flow of the ink through the inkjet-printing device, especially at the ejecting nozzles. It is also desirable to use small particles for maximum colour strength and to slow down sedimentation.

The numeric average pigment particle size is preferably between 0.050 and 1 μm, more preferably between 0.070 and 0.300 μm and particularly preferably between 0.080 and 0.200 μm. Most preferably, the numeric average pigment particle size is no larger than 0.150 μm. An average particle size smaller than 0.050 μm is less desirable for decreased light-fastness.

However for white pigment inkjet inks, the numeric average particle diameter of the white pigment is preferably from 150 to 500 nm, more preferably from 200 to 400 nm, and most preferably from 250 to 300 nm. Sufficient hiding power cannot be obtained when the average diameter is less than 150 nm, and the storage ability and the jet-out suitability of the ink tend to be degraded when the average diameter exceeds 500 nm. The determination of the numeric average particle diameter is best performed by photon correlation spectroscopy at a wavelength of 633 nm with a 4 mW HeNe laser on a diluted sample of the pigmented inkjet ink. A suitable particle size analyzer used was a Malvern™ nano-S available from Goffin-Meyvis. A sample can, for example, be prepared by addition of one drop of ink to a cuvette containing 1.5 mL ethyl acetate and mixed until a homogenous sample was obtained. The measured particle size is the average value of 3 consecutive measurements consisting of 6 runs of 20 seconds.

Suitable white pigments are given by Table 2 in [0116] of WO 2008/074548 (AGFA GRAPHICS). The white pigment is preferably a pigment with a refractive index greater than 1.60. The white pigments may be employed singly or in combination. Preferably titanium dioxide is used as pigment with a refractive index greater than 1.60. Suitable titanium dioxide pigments are those disclosed in [0117] and in [0118] of WO 2008/074548 (AGFA GRAPHICS).

The pigments are present in the range of 0.01 to 15%, more preferably in the range of 0.05 to 10% by weight and most preferably in the range of 0.1 to 5% by weight, each based on the total weight of the inkjet ink. For white pigmented ink, the white pigment is preferably present in an amount of 3% to 30% by weight of the inkjet ink, and more preferably 5% to 25%. An amount of less than 3% by weight cannot achieve sufficient covering power and usually exhibits very poor storage stability and ejection property.

Polymeric Dispersants

Typical polymeric dispersants are copolymers of two monomers but may contain three, four, five or even more monomers. The properties of polymeric dispersants depend on both the nature of the monomers and their distribution in the polymer. Copolymeric dispersants preferably have the following polymer compositions:

- statistically polymerized monomers (e.g. monomers A and B polymerized into ABBAABAB);
- alternating polymerized monomers (e.g. monomers A and B polymerized into ABABABAB);
- gradient (tapered) polymerized monomers (e.g. monomers A and B polymerized into AAABAABBABBB);
- block copolymers (e.g. monomers A and B polymerized into AAAAABBBBBB) wherein the block length of each of the blocks (2, 3, 4, 5 or even more) is important for the dispersion capability of the polymeric dispersant;
- graft copolymers (graft copolymers consist of a polymeric backbone with polymeric side chains attached to the backbone); and
- mixed forms of these polymers, e.g. blocky gradient copolymers.

Suitable polymeric dispersants are listed in the section on "Dispersants", more specifically [0064] to [0070] and [0074] to [0077], in EP 1911814 A (AGFA GRAPHICS) incorporated herein as a specific reference.

The polymeric dispersant has preferably a number average molecular weight Mn between 500 and 30000, more preferably between 1500 and 10000.

The polymeric dispersant has preferably a weight average molecular weight Mw smaller than 100,000, more preferably smaller than 50,000 and most preferably smaller than 30,000.

The polymeric dispersant has preferably a polydispersity PD smaller than 2, more preferably smaller than 1.75 and most preferably smaller than 1.5.

Commercial examples of polymeric dispersants are the following:

- DISPERBYK™ dispersants available from BYK CHEMIE GMBH;
- SOLSPERSE™ dispersants available from NOVEON;
- TEGO™ DISPERS™ dispersants from EVONIK;
- EDAPLAN™ dispersants from MUNZING CHEMIE;
- ETHACRYL™ dispersants from LYONDELL;
- GANEX™ dispersants from ISP;

DISPEX™ and EFKA™ dispersants from CIBA SPECIALTY CHEMICALS INC;

DISPONER™ dispersants from DEUCHEM; and

JONCRYL™ dispersants from JOHNSON POLYMER.

Particularly preferred polymeric dispersants include Solsperse™ dispersants from NOVEON, Efka™ dispersants from CIBA SPECIALTY CHEMICALS INC and Disperbyk™ dispersants from BYK CHEMIE GMBH. Particularly preferred dispersants are Solsperse™ 32000, 35000 and 39000 dispersants from NOVEON.

The polymeric dispersant is preferably used in an amount of 2 to 600 wt %, more preferably 5 to 200 wt %, most preferably 50 to 90 wt % based on the weight of the pigment.

Dispersion Synergists

A dispersion synergist usually consists of an anionic part and a cationic part. The anionic part of the dispersion synergist exhibiting a certain molecular similarity with the color pigment and the cationic part of the dispersion synergist consists of one or more protons and/or cations to compensate the charge of the anionic part of the dispersion synergist.

The synergist is preferably added in a smaller amount than the polymeric dispersant(s). The ratio of polymeric dispersant/dispersion synergist depends upon the pigment and should be determined experimentally. Typically the ratio wt % polymeric dispersant/wt % dispersion synergist is selected between 2:1 to 100:1, preferably between 2:1 and 20:1.

Suitable dispersion synergists that are commercially available include Solsperse™ 5000 and Solsperse™ 22000 from NOVEON.

Particular preferred pigments for the magenta ink used are a diketopyrrolo-pyrrole pigment or a quinacridone pigment. Suitable dispersion synergists include those disclosed in EP 1790698 A (AGFA GRAPHICS), EP 1790696 A (AGFA GRAPHICS), WO 2007/060255 (AGFA GRAPHICS) and EP 1790695 A (AGFA GRAPHICS).

In dispersing C.I. Pigment Blue 15:3, the use of a sulfonated Cu-phthalocyanine dispersion synergist, e.g. Solsperse™ 5000 from NOVEON is preferred. Suitable dispersion synergists for yellow inkjet inks include those disclosed in EP 1790697 A (AGFA GRAPHICS).

Polymerizable Compounds

The UV curable colourless primer and/or UV curable colour inkjet inks preferably contain polymerizable compounds in an amount higher than 70 wt %, more preferably 75 wt %, wherein the wt % is based on the total weight of the primer respectively the inkjet ink.

Any monomer and oligomer capable of free radical polymerization may be used as polymerizable compound. The monomers and oligomers may have different degrees of polymerizable functionality, and a mixture including combinations of mono-, di-, tri- and higher polymerizable functionality monomers may be used. The viscosity of the UV curable inkjet ink can be adjusted by varying the ratio between the monomers.

Particularly preferred monomers and oligomers are those listed in [0106] to [0115] in EP 1911814 A (AGFA).

In a preferred embodiment, the UV curable colourless primer and/or colour inkjet ink contains a vinylether acrylate. Preferred vinylether acrylates are those disclosed in U.S. Pat. No. 6,310,115 (AGFA). A particularly preferred compound is 2-(2-vinyloxyethoxy)ethyl acrylate. Other suitable vinylether acrylates are those disclosed in columns 3 and 4 of US 67679890 B (NIPPON SHOKUBAI), incorporated herein by specific reference.

In a preferred embodiment, the UV curable colour inkjet ink includes at least one monomer selected from the group consisting of 2-(vinylethoxy)ethyl acrylate, N-vinyl caprolactam, phenoxyethyl acrylate, isobornyl acrylate dipropyleneglycoldiacrylate, ethoxylated trimethylolpropane triacrylate and cyclic trimethylolpropane formal acrylate.

The UV curable colourless primer and colour inkjet ink are preferably free radical curable. It was found in industrial inkjet printing systems that cationically curable inkjet inks posed problems of jetting reliability due to UV stray light. The UV-curing of the ink caused reflections of UV light, including UV light hitting the nozzle plate of an inkjet print head and resulting into failing nozzles due to clogging by cured ink in the nozzle. Unlike free radical ink where radical species have a much shorter lifetime, the cationic curable ink continues to cure once an acid species has been generated by UV light in the nozzle.

Photoinitiators and Co-Initiators

The photoinitiator is preferably a free radical initiator. A free radical photoinitiator is a chemical compound that initiates polymerization of monomers and oligomers when exposed to actinic radiation by the formation of a free radical.

Two types of free radical photoinitiators can be distinguished and used in the inkjet ink of a preferred embodiment of the present invention. A Norrish Type I initiator is an initiator which cleaves after excitation, yielding the initiating radical immediately. A Norrish type II-initiator is a photoinitiator which is activated by actinic radiation and forms free radicals by hydrogen abstraction from a second compound that becomes the actual initiating free radical. This second compound is called a polymerization synergist or co-initiator. Both type I and type II photoinitiators can be used in the present invention, alone or in combination.

In order to increase the photosensitivity further, the UV curable ink may additionally contain co-initiators. Suitable examples of co-initiators can be categorized in three groups:

(1) tertiary aliphatic amines such as methyldiethanolamine, dimethylethanolamine, triethanolamine, triethylamine and N-methylmorpholine;

(2) aromatic amines such as amylparadimethylaminobenzoate, 2-n-butoxyethyl-4-(dimethylamino) benzoate, 2-(dimethylamino)ethylbenzoate, ethyl-4-(dimethylamino)benzoate, and 2-ethylhexyl-4-(dimethylamino)benzoate; and (3) (meth)acrylated amines such as dialkylamino alkyl (meth)acrylates (e.g., diethylaminoethylacrylate) or N-morpholinoalkyl-(meth)acrylates (e.g., N-morpholinoethylacrylate).

The preferred co-initiators are aminobenzoates.

Suitable photo-initiators are disclosed in CRIVELLO, J. V., et al. VOLUME III: Photoinitiators for Free Radical Cationic. 2nd edition. Edited by BRADLEY, G. London, UK: John Wiley and Sons Ltd, 1998. p. 287-294.

Specific examples of photo-initiators may include, but are not limited to, the following compounds or combinations thereof: benzophenone and substituted benzophenones, 1-hydroxycyclohexyl phenyl ketone, thioxanthones such as isopropylthioxanthone, 2-hydroxy-2-methyl-1-phenylpropan-1-one, 2-benzyl-2-dimethylamino-(4-morpholinophenyl) butan-1-one, benzil dimethylketal, bis (2,6-dimethylbenzoyl)-2,4,4-trimethylpentylphosphine oxide, 2,4,6trimethylbenzoyldiphenylphosphine oxide, 2-methyl-1-[4-(methylthio) phenyl]-2-morpholinopropan-1-one, 2,2-dimethoxy-1,2-diphenylethan-1-one or 5,7-diiodo-3-butoxy-6-fluorone.

Suitable commercial photo-initiators include Irgacure™ 184, Irgacure™ 500, Irgacure™ 907, Irgacure™ 369, Irgacure™ 1700, Irgacure™ 651, Irgacure™ 819, Irgacure™ 1000, Irgacure™ 1300, Irgacure™ 1870, Darocur™ 1173, Darocur™ 2959, Darocur™ 4265 and Darocur™ ITX available from CIBA SPECIALTY CHEMICALS, Lucerin™ TPO available from BASF AG, Esacure™ KT046, Esacure™ KIP150, Esacure™ KT37 and Esacure™ EDB available from LAMBERTI, H-Nu™ 470 and H-Nu™ 470X available from SPECTRA GROUP Ltd.

In a preferred embodiment, the photoinitiator is selected from the group consisting of non-polymeric multifunctional photoinitiators, oligomeric or polymeric photoinitiators and polymerizable photoinitiators. Such a diffusion hindered photoinitiator exhibits a much lower mobility in a cured layer of the UV curable colourless primer and colour inkjet inks than a low molecular weight monofunctional photoinitiator, such as benzophenone. Including diffusion hinderd photoinitiators, and also diffusion hindered co-initiators do not only have a safety advantage for the operator of the inkjet printer, but are also environmentally friendly as these compounds cannot be leached out from the outdoor billboard by e.g. acid rain.

Most preferably the diffusion hindered photoinitiator is a polymerizable photoinitiator, preferably having at least one acrylate group. And most preferably the diffusion hindered coinitiator is a polymerizable coinitiator, preferably having at least one acrylate group.

Suitable diffusion hindered photoinitiator may contain one or more photoinitiating functional groups derived from a Norrish type I-photoinitiator selected from the group consisting of benzoinethers, benzil ketals, α,α-dialkoxyacetophenones, α-hydroxyalkylphenones, α-aminoalkylphenones, acylphosphine oxides, acylphosphine sulfides, α-haloketones, α-halosulfones and phenylglyoxalates.

A suitable diffusion hindered photoinitiator may contain one or more photoinitiating functional groups derived from a Norrish type II-initiator selected from the group consisting of benzophenones, thioxanthones, 1,2-diketones and anthraquinones.

Suitable diffusion hindered photoinitiators are also those disclosed in EP 2053101 A (AGFA GRAPHICS) in paragraphs [0074] and [0075] for difunctional and multifunctional photoinitiators, in paragraphs [0077] to [0080] for polymeric photoinitiators and in paragraphs [0081] to [0083] for polymerizable photoinitiators.

Other preferred polymerizable photoinitiators are those disclosed in EP 2065362 A (AGFA) and EP 2161264 A (AGFA), incorporated herein by reference.

In a preferred embodiment, the UV curable colourless primer includes no thioxanthone type photoinitiator. UV curable colourless primers including thioxanthone type photoinitiators generally exhibit strong photoyellowing.

A preferred amount of photoinitiator is 0-50 wt %, more preferably 0.1-20 wt %, and most preferably 0.3-15 wt % of the total weight of the curable pigment dispersion or ink.

Preferred diffusion hindered co-initiators are the polymerizable co-initiators disclosed in EP 2053101 A (AGFA GRAPHICS) in paragraphs [0088] and [0097].

Preferred diffusion hindered co-initiators include a polymeric co-initiator having a dendritic polymeric architecture, more preferably a hyperbranched polymeric architecture. Preferred hyperbranched polymeric co-initiators are those disclosed in US 2006014848 (AGFA) incorporated herein as a specific reference.

The UV curable ink preferably comprises the diffusion hindered co-initiator in an amount of 0.1 to 50 wt %, more preferably in an amount of 0.5 to 25 wt %, most preferably in an amount of 1 to 10 wt % of the total weight of the ink.

Polymerization Inhibitors

The UV curable colourless primer and colour inkjet ink may contain a polymerization inhibitor. Suitable polymerization inhibitors include phenol type antioxidants, hindered amine light stabilizers, phosphor type antioxidants, hydroquinone monomethyl ether commonly used in (meth)acrylate monomers, and hydroquinone, t-butylcatechol, pyrogallol may also be used.

Suitable commercial inhibitors are, for example, Sumilizer™ GA-80, Sumilizer™ GM and Sumilizer™ GS produced by Sumitomo Chemical Co. Ltd.; Genorad™ 16, Genorad™ 18 and Genorad™ 20 from Rahn AG; Irgastab™ UV10 and Irgastab™ UV22, Tinuvin™ 460 and CGS20 from Ciba Specialty Chemicals; Floorstab™ UV range (UV-1, UV-2, UV-5 and UV-8) from Kromachem Ltd, Additol™ S range (S100, S110, S120 and S130) from Cytec Surface Specialties.

Since excessive addition of these polymerization inhibitors will lower the ink sensitivity to curing, it is preferred that the amount capable of preventing polymerization is determined prior to blending. The amount of a polymerization inhibitor is preferably lower than 2 wt % based on the total weight of the primer or inkjet ink.

Surfactants

Surfactants are used in inkjet inks to reduce the surface tension of the ink in order to reduce the contact angle on the colourless primer, i.e. to improve the wetting of the colourless primer by the ink. On the other hand, the jettable ink must meet stringent performance criteria in order to be adequately jettable with high precision, reliability and during an extended period of time. To achieve both wetting of the substrate by the ink and high jetting performance, typically, the surface tension of the ink is reduced by the addition of one or more surfactants. In the case of UV curable inkjet inks, however, the surface tension of the inkjet ink is not only determined by the amount and type of surfactant, but also by the polymerizable compounds, the polymeric dispersants and other additives in the ink composition.

The surfactant(s) can be anionic, cationic, non-ionic, or zwitter-ionic and are usually added in a total quantity less than 20 wt % based on the total weight of the inkjet ink and particularly in a total less than 10 wt % based on the total weight of the inkjet ink.

Suitable surfactants include fluorinated surfactants, fatty acid salts, ester salts of a higher alcohol, alkylbenzene sulphonate salts, sulphosuccinate ester salts and phosphate ester salts of a higher alcohol (for example, sodium dodecylbenzenesulphonate and sodium dioctylsulphosuccinate), ethylene oxide adducts of a higher alcohol, ethylene oxide adducts of an alkylphenol, ethylene oxide adducts of a polyhydric alcohol fatty acid ester, and acetylene glycol and ethylene oxide adducts thereof (for example, polyoxyethylene nonylphenyl ether, and SURFYNOL™ 104, 104 H, 440, 465 and TG available from AIR PRODUCTS & CHEMICALS INC.).

Preferred surfactants include fluoro surfactants (such as fluorinated hydrocarbons) and silicone surfactants. The silicones are typically siloxanes and can be alkoxylated, polyether modified, polyester modified, polyether modified hydroxy functional, amine modified, epoxy modified and other modifications or combinations thereof. Preferred siloxanes are polymeric, for example polydimethylsiloxanes.

The fluorinated or silicone compound used as a surfactant may be a cross-linkable surfactant. Suitable copolymerizable compounds having surface-active effects include, for example, polyacrylate copolymers, silicone modified acrylates, silicone modified methacrylates, acrylated siloxanes, polyether modified acrylic modified siloxanes, fluorinated acrylates, and fluorinated methacrylate. These acrylates can be mono-, di-, tri- or higher functional (meth)acrylates.

Depending upon the application a surfactant can be used with a high, low or intermediate dynamic surface tension. Silicone surfactants are generally known to have low dynamic surface tensions while fluorinated surfactants are known to have higher dynamic surface tensions.

Silicone surfactants are often preferred in curable inkjet inks, especially the reactive silicone surfactants, which are able to be polymerized together with the polymerizable compounds during the curing step.

Examples of useful commercial silicone surfactants are those supplied by BYK CHEMIE GMBH (including Byk™-302, 307, 310, 331, 333, 341, 345, 346, 347, 348, UV3500, UV3510 and UV3530), those supplied by TEGO CHEMIE SERVICE (including Tego Rad™ 2100, 2200 N, 2250, 2300, 2500, 2600 and 2700), Ebecryl™ 1360 a polysilixone hexaacrylate from CYTEC INDUSTRIES BV and Efka™-3000 series (including Efka™-3232 and Efka™-3883) from EFKA CHEMICALS B.V.

Preparation of Pigment Dispersions and Inks

Pigment dispersions may be prepared by precipitating or milling the pigment in the dispersion medium in the presence of the dispersant.

Mixing apparatuses may include a pressure kneader, an open kneader, a planetary mixer, a dissolver, and a Dalton Universal Mixer. Suitable milling and dispersion apparatuses are a ball mill, a pearl mill, a colloid mill, a high-speed disperser, double rollers, a bead mill, a paint conditioner, and triple rollers. The dispersions may also be prepared using ultrasonic energy.

Many different types of materials may be used as milling media, such as glasses, ceramics, metals, and plastics. In a preferred embodiment, the grinding media can comprise particles, preferably substantially spherical in shape, e.g. beads consisting essentially of a polymeric resin or yttrium stabilized zirconium beads.

In the process of mixing, milling and dispersion, each process is performed with cooling to prevent build up of heat, and for UV curable pigment dispersions as much as possible under light conditions in which actinic radiation has been substantially excluded.

The pigment dispersion may contain more than one pigment. Such a pigment dispersion may be prepared using separate dispersions for each pigment, or alternatively several pigments may be mixed and co-milled in preparing the dispersion.

The dispersion process can be carried out in a continuous, batch or semi-batch mode.

The preferred amounts and ratios of the ingredients of the mill grind will vary widely depending upon the specific materials and the intended applications. The contents of the milling mixture comprise the mill grind and the milling media. The mill grind comprises pigment, polymeric dispersant and a liquid carrier. For inkjet inks, the pigment is usually present in the mill grind at 1 to 50 wt %, excluding the milling media. The weight ratio of pigment over polymeric dispersant is 20:1 to 1:2.

The milling time can vary widely and depends upon the pigment, the selected mechanical means and residence conditions, the initial and desired final particle size, etc. In a preferred embodiment of the present invention pigment dispersions with an average particle size of less than 100 nm may be prepared.

After milling is completed, the milling media is separated from the milled particulate product (in either a dry or liquid dispersion form) using conventional separation techniques, such as by filtration, sieving through a mesh screen, and the like. Often the sieve is built into the mill, e.g. for a bead mill. The milled pigment concentrate is preferably separated from the milling media by filtration.

In general it is desirable to make inkjet inks in the form of a concentrated mill grind, which is subsequently diluted to the appropriate concentration for use in the inkjet printing system. This technique permits preparation of a greater quantity of pigmented ink from the equipment. By dilution, the inkjet ink is adjusted to the desired viscosity, surface tension, colour, hue, saturation density, and print area coverage for the particular application.

Inkjet Printing Devices

The primer and inkjet inks may be jetted by one or more print heads ejecting small droplets of ink in a controlled manner through nozzles onto an ink-receiver surface, which is moving relative to the print head(s).

A preferred print head for the inkjet printing system is a piezoelectric head. Piezoelectric inkjet printing is based on the movement of a piezoelectric ceramic transducer when a voltage is applied thereto. The application of a voltage changes the shape of the piezoelectric ceramic transducer in the print head creating a void, which is then filled with ink. When the voltage is again removed, the ceramic expands to its original shape, ejecting a drop of ink from the print head. However an inkjet printing method according to the present invention is not restricted to piezoelectric inkjet printing. Other inkjet print heads can be used and include various types, such as a continuous type and thermal, electrostatic and acoustic drop on demand type.

The inkjet print head normally scans back and forth in a transversal direction across the moving ink-receiver surface. Often the inkjet print head does not print on the way back. Bi-directional printing is preferred for obtaining a high areal throughput. Another preferred printing method is by a "single pass printing process", which can be performed by using page wide inkjet print heads or multiple staggered inkjet print heads which cover the entire width of the ink-receiver surface. In a single pass printing process the inkjet print heads usually remain stationary and the ink-receiver surface is transported under the inkjet print heads.

Curing Devices

The UV curable inkjet inks according to preferred embodiments of the present invention can be cured by exposing them to actinic radiation, preferably by ultraviolet radiation.

In inkjet printing, the curing means may be arranged in combination with the print head of the inkjet printer, travelling therewith so that the curable composition is exposed to curing radiation very shortly after been jetted.

In such an arrangement it can be difficult to provide a small enough radiation source connected to and travelling with the print head. Therefore, a static fixed radiation source may be employed, e.g. a source of curing UV-light, connected to the radiation source by means of flexible radiation conductive means such as a fiber optic bundle or an internally reflective flexible tube.

Alternatively, the actinic radiation may be supplied from a fixed source to the radiation head by an arrangement of mirrors including a mirror upon the radiation head.

The source of radiation arranged not to move with the print head, may also be an elongated radiation source extending transversely across the ink-receiver surface to be cured and adjacent the transverse path of the print head so that the subsequent rows of images formed by the print head are passed, stepwise or continually, beneath that radiation source.

Any ultraviolet light source, as long as part of the emitted light can be absorbed by the photo-initiator or photo-initiator system, may be employed as a radiation source, such as, a high or low pressure mercury lamp, a cold cathode tube, a black light, an ultraviolet LED, an ultraviolet laser, and a flash light. Of these, the preferred source is one exhibiting a relatively long wavelength UV-contribution having a dominant wavelength of 300-400 nm. Specifically, a UV-A light source is preferred due to the reduced light scattering therewith resulting in more efficient interior curing.

UV radiation is generally classed as UV-A, UV-B, and UV-C as follows:

UV-A: 400 nm to 320 nm

UV-B: 320 nm to 290 nm

UV-C: 290 nm to 100 nm.

Furthermore, it is possible to cure the image using, consecutively or simultaneously, two light sources of differing wavelength or illuminance. For example, the first UV-source can be selected to be rich in UV-C, in particular in the range of 260 nm-200 nm. The second UV-source can then be rich in UV-A, e.g. a gallium-doped lamp, or a different lamp high in both UV-A and UV-B. The use of two UV-sources has been found to have advantages e.g. a fast curing speed and a high curing degree.

For facilitating curing, the inkjet printer often includes one or more oxygen depletion units. The oxygen depletion units place a blanket of nitrogen or other relatively inert gas (e.g. $CO_2$), with adjustable position and adjustable inert gas concentration, in order to reduce the oxygen concentration in the curing environment. Residual oxygen levels are usually maintained as low as 200 ppm, but are generally in the range of 200 ppm to 1200 ppm.

EXAMPLES

Materials

All materials used in the following examples were readily available from standard sources such as Sigma-Aldrich (Belgium) and Acros (Belgium) unless otherwise specified.

PB15:4 is an abbreviation used for Hostaperm™ Blue P-BFS, a C.I. Pigment Blue 15:4 pigment from CLARIANT.

MP1 is an abbreviation used for Inkjet Magenta 2BC, a quinacridone pigment from BASF.

PY150 is a C.I. Pigment Yellow 150 pigment for which Cromophtal yellow LA2 from BASF was used.

PY151 is a C.I. Pigment Yellow 151 pigment for which Lysopac™ Geel 5115 C from CAPELLE PIGMENTS NV was used.

PY155 is a C.I. Pigment Yellow 155 pigment for which Inkjet™ Yellow 4GC VP3854 from CLARIANT was used.

PY180 is a C.I. Pigment Yellow 180 pigment for which Toner Yellow HG from CLARIANT was used.

PB7 is an abbreviation used for Special Black™ 550, which is a carbon black available from EVONIK DEGUSSA.

SYN is the dispersion synergist according to Formula (A):

Formula (A)

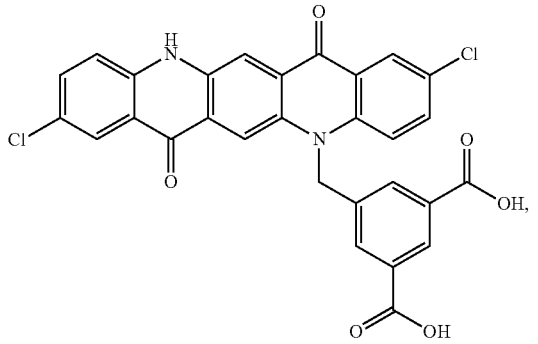

and was synthesized in the same manner as described in Example 1 of WO 2007/060254 (AGFA GRAPHICS) for the synergist QAD-3.

S35000 is an abbreviation for SOLSPERSE™ 35000, a polyethyleneimine-polyester hyperdispersant from NOVEON.

INHIB is a mixture forming a polymerization inhibitor having a composition according to Table 1.

TABLE 1

| Component | wt % |
|---|---|
| DPGDA | 82.4 |
| p-methoxyphenol | 4.0 |
| BHT | 10.0 |
| Cupferron ™ AL | 3.6 |

Cupferron™ AL is aluminum N-nitrosophenylhydroxylamine from WAKO CHEMICALS LTD.

BYK™ UV3510 is a polyethermodified polydimethylsiloxane wetting agent available from BYK CHEMIE GMBH.

DPGDA is dipropyleneglycoldiacrylate from SARTOMER.

IBOA is isobornylacrylate available as Sartomer™ SR506D from SARTOMER.

IDA is isodecyl acrylate available as Sartomer™ SR395 from SARTOMER.

PG400DA is polyethyleneglycol 400 diacrylate available as Sartomer™ SR344 from SARTOMER.

CN435 is an ethoxylated (15) trimethylolpropane triacrylate containing fifteen ethoxy units having a molecular weight of 956 and available as Sartomer™ SR9035 from SARTOMER.

ITX is Darocur™ ITX is an isomeric mixture of 2- and 4-isopropylthioxanthone from BASF.

I907 is an abbreviation for Irgacure™ 907 is a photo-initiator available from BASF.

I379 is an abbreviation for Irgacure™ 379 is a photo-initiator available from BASF.

TPO is trimethylbenzoyl diphenyl phosphine oxide supplied as Omnirad™ TPO by IGM.

CN3755 is an acrylated amine synergist available as Sartomer™ CN3755 from SARTOMER.

EPD is ethyl 4-dimethylaminobenzoate available as Genocure™ EPD from RAHN AG.

Irgastab™ UV 10 is 4-hydroxy-2,2,6,6-tetramethylpiperidinooxy sebacate available from BASF.

PP is a polypropylene substrate for which BiPrint 650 gr 3.5 mm from ANTALIS, Belgium was used.

Measurement Methods

1. Viscosity

The viscosity of the UV curable compositions was measured at 45° C. and at a shear rate of 1,000 $s^{-1}$ using a Rotovisco™ RV1 viscometer from HAAKE.

2. Curing Sensitivity

The curing sensitivity of a UV curable composition was determined by coating the UV curable composition on a 50 μm thick PET film using a bar coater and a 10 μm wired bar. The coated samples were cured using a Fusion DRSE-120 conveyer, equipped with a Fusion VPS/1600 lamp (D-bulb). The samples were passed under the lamp at a belt speed of 20 m/min and at full power of the lamp. The administered dose in $mJ/cm^2$ was determined using a UV Power Puck 8651 from EIT Inc. (USA).

3. Surface Tension

The static surface tension of the UV curable inks was measured with a KRÜSS tensiometer K9 from KRÜSS GmbH, Germany at 25° C. after 60 seconds.

4. Average Particle Size

The average particle size (diameter) was determined with a Brookhaven Instruments Particle Sizer BI90plus based upon the principle of dynamic light scattering. The dispersion was diluted with ethyl acetate to a pigment concentration of 0.002 wt %. The measurement settings of the BI90plus were: 5 runs at 23° C., angle of 90°, wavelength of 635 nm and graphics=correction function.

5. Flaking Off

The samples were subjected to an accelerated weather conditions test for 5 weeks in a Ci4000 Weather-Ometer™ from Atlas Material Testing Technology. The testing conditions applied were those prescribed by ISO18930. The evaluation was made in accordance with the classification described in Table 2. Samples exhibiting good flaking of properties must have a classification of 1 as this impacts the image the most.

TABLE 2

| Classification | Observation |
|---|---|
| 1 | No flaking off |
| 2 | Minor flaking off |
| 3 | Major flaking off |

6. Light Fading

The samples were subjected to an accelerated weather conditions test for 3 weeks in a Ci4000 Weather-Ometer™ from Atlas Material Testing Technology. The testing conditions applied were those prescribed by ISO18930. The evaluation was made in accordance with the classification described in Table 3 for yellow print areas as these were found to suffer most from light fading. Samples exhibiting good light fading have a classification of at least 2, preferably a classification of 1.

TABLE 3

| Classification | Observation |
|---|---|
| 1 | $\Delta E94 < 9$ |
| 2 | $9 < \Delta E94 < 12$ |
| 3 | $\Delta E94 > 12$ |

7. Flexibility

The flexibility of a sample was determined using a custom built apparatus for stretching a strip having a length of 8 cm and a width of 1 cm obtained from the coated sample using a cutter. The strip was mounted between a first fixed wall and a second wall which could be horizontally deplaced by rotation of a handle.

The strip was elongated from an original length L1 of 5 cm to the length L2 at which the ink layer exhibited cracking or the strip ruptured. The elongation was calculated as a percentage according to Formula (III):

$$\text{Elongation } (\%)=(L2-L1/L1)\times 100 \qquad \text{Formula (III).}$$

The evaluation of the flexibility was made in accordance with the classification described in Table 4. Samples exhibiting good flexibility must have a classification of 1.

TABLE 4

| Classification | Observation |
|---|---|
| 1 | More than 45% elongation |
| 2 | From 40% to 45% elongation |
| 3 | Less than 40% elongation |

Example 1

This example illustrates the improved results for weather resistance, light fading, flexibility and hardness using an inkjet printing method in accordance with the present invention.

Preparation of UV Curable Colourless Primers

The UV curable colourless primers P-1 to P-6 were prepared by mixing the components according to Table 5. The wt % is based on the total weight of the primer.

TABLE 5

| wt % of: | P-1 | P-2 | P-3 | P-4 | P-5 | P-6 |
|---|---|---|---|---|---|---|
| DPGDA | — | 15.00 | 25.00 | 35.00 | 50.00 | 76.55 |
| IBOA | 76.55 | 61.55 | 51.55 | 41.55 | 26.55 | — |
| TPO | 10.00 | 10.00 | 10.00 | 10.00 | 10.00 | 10.00 |
| CN3755 | 13.00 | 13.00 | 13.00 | 13.00 | 13.00 | 13.00 |
| Irgastab ™ UV10 | 0.35 | 0.35 | 0.35 | 0.35 | 0.35 | 0.35 |
| Byk ™ UV 3510 | 0.10 | 0.10 | 0.10 | 0.10 | 0.10 | 0.10 |

The viscosity and the curing sensitivity of the primers P-1 to P-6 were determined. The results are shown in Table 6.

TABLE 6

| Primer | Viscosity | Curing Sensitivity |
|---|---|---|
| P-1 | 9.8 mPa · s | >3500 $mJ/cm^2$ |
| P-2 | 10.2 mPa · s | 1467 $mJ/cm^2$ |
| P-3 | 10.3 mPa · s | 848 $mJ/cm^2$ |
| P-4 | 10.9 mPa · s | 641 $mJ/cm^2$ |
| P-5 | 10.6 mPa · s | 538 $mJ/cm^2$ |
| P-6 | 11.3 mPa · s | 434 $mJ/cm^2$ |

All the primers exhibited a viscosity suitable for inkjet printing. All primers except primer P-1, containing a very high amount of monofunctional monomers, exhibited a desired curing sensitivity for inkjet printing. The curing sensitivity of P-1 would reduce through-put or require a more expensive printer, and was therefore not used in further experiments. The surface tension of the all primers was between 27 and 29 mN/m.

Preparation of Concentrated Pigment Dispersions

Concentrated Cyan Pigment Dispersion CPC

A dispersion was made by mixing the components according to Table 6 for 30 minutes using a DISPERLUX™ disperser from DISPERLUX S.A.R.L., Luxembourg. The dispersion was then milled using a Bachofen DYNOMILL ECM mill filled with 0.4 mm yttrium stabilized zirconia beads ("high wear resistant zirconia grinding media" from TOSOH Co.). The mixture was circulated over the mill for 2 hours. After milling, the concentrated pigment dispersion was discharged over a 1 μm filter into a vessel. The resulting concentrated pigment dispersion CPC had an average particle size of 133 nm.

TABLE 7

| Component | wt % |
|---|---|
| PB15:4 | 16.00 |
| S35000 | 16.00 |
| INHIB | 1.00 |
| DPGDA | 67.00 |

Concentrated Magenta Pigment Dispersion CPM

A dispersion was made by mixing the components according to Table 8 for 30 minutes using a DISPERLUX™ disperser from DISPERLUX S.A.R.L., Luxembourg. The dispersion was then milled using a Bachofen DYNOMILL ECM mill filled with 0.4 mm yttrium stabilized zirconia beads ("high wear resistant zirconia grinding media" from TOSOH Co.). The mixture was circulated over the mill for 2 hours. After milling, the concentrated pigment dispersion was discharged over a 1 μm filter into a vessel. The resulting concentrated pigment dispersion CPM had an average particle size of 137 nm.

TABLE 8

| Component | wt % |
|---|---|
| MP1 | 16.00 |
| SYN | 0.24 |
| S35000 | 16.00 |
| INHIB | 1.00 |
| DPGDA | 66.76 |

Concentrated Yellow Pigment Dispersion CPY

A dispersion was made by mixing the components according to Table 9 for 30 minutes using a DISPERLUX™ disperser from DISPERLUX S.A.R.L., Luxembourg. The dispersion was then milled using a Bachofen DYNOMILL ECM mill filled with 0.4 mm yttrium stabilized zirconia beads ("high wear resistant zirconia grinding media" from TOSOH Co.). The mixture was circulated over the mill for 2 hours. After milling, the concentrated pigment dispersion was discharged over a 1 μm filter into a vessel. The resulting concentrated pigment dispersion CPY had an average particle size of 165 nm.

TABLE 9

| Component | wt % |
|---|---|
| PY150 | 16.00 |
| Sol35 | 16.00 |
| INHIB | 1.00 |
| DPGDA | 67.00 |

Concentrated Black Pigment Dispersion CPK

A dispersion was made by mixing the components according to Table 10 for 30 minutes using a DISPERLUX™ disperser from DISPERLUX S.A.R.L., Luxembourg. The dispersion was then milled using a Bachofen DYNOMILL ECM mill filled with 0.4 mm yttrium stabilized zirconia beads ("high wear resistant zirconia grinding media" from TOSOH Co.). The mixture was circulated over the mill for 2 hours. After milling, the concentrated pigment dispersion was discharged over a 1 μm filter into a vessel. The resulting concentrated pigment dispersion CPK had an average particle size of 96 nm.

TABLE 10

| Component | wt % |
|---|---|
| PB7 | 16.00 |
| Sol35 | 16.00 |
| INHIB | 1.00 |
| DPGDA | 67.00 |

Preparation of UV Curable Inkjet Inks

Four UV curable CMYK inkjet ink sets 1 to 4 were prepared using the above prepared concentrated pigment dispersions and combining them with the other components according to Table II and Table 12. The wt % is based on the total weight of the inkjet ink.

TABLE 11

| | CMYK ink set 1 | | | | CMYK ink set 2 | | | |
|---|---|---|---|---|---|---|---|---|
| wt % of: | C1 | M1 | Y1 | K1 | C2 | M2 | Y2 | K2 |
| CPC | 18.75 | — | — | 4.50 | 18.75 | — | — | 4.50 |
| CPM | — | 21.88 | — | 4.50 | — | 21.88 | — | 4.50 |
| CPY | — | — | 16.88 | — | — | — | 16.88 | 0.00 |
| CPK | — | — | — | 12.50 | — | — | — | 12.50 |
| DPGDA | 36.34 | 35.74 | 35.69 | 34.11 | 21.34 | 20.74 | 20.69 | 19.11 |
| PG400DA | 10.00 | 10.00 | 10.00 | 15.00 | 10.00 | 10.00 | 10.00 | 15.00 |
| CN435 | 7.50 | 5.00 | 10.00 | — | 7.50 | 5.00 | 10.00 | — |
| IDA | 15.00 | 15.00 | 15.00 | 15.00 | 15.00 | 15.00 | 15.00 | 15.00 |
| IBOA | — | — | — | — | 15.00 | 15.00 | 15.00 | 15.00 |
| EPD | 2.50 | 2.50 | 2.50 | 2.50 | 2.50 | 2.50 | 2.50 | 2.50 |
| ITX | 5.00 | 5.00 | 5.00 | 5.00 | 5.00 | 5.00 | 5.00 | 5.00 |
| I907 | 4.00 | 4.00 | 4.00 | 5.00 | 4.00 | 4.00 | 4.00 | 5.00 |
| I379 | — | — | — | 1.00 | — | — | — | 1.00 |
| Byk ™ UV 3510 | 0.10 | 0.10 | 0.10 | 0.10 | 0.10 | 0.10 | 0.10 | 0.10 |
| INHIB | 0.81 | 0.78 | 0.83 | 0.79 | 0.81 | 0.78 | 0.83 | 0.79 |

TABLE 12

| | CMYK ink set 3 | | | | CMYK ink set 4 | | | |
|---|---|---|---|---|---|---|---|---|
| wt % of: | C3 | M3 | Y3 | K3 | C4 | M4 | Y4 | K4 |
| CPC | 18.75 | — | — | 4.50 | 18.75 | — | — | 4.50 |
| CPM | — | 21.88 | — | 4.50 | — | 21.88 | — | 4.50 |
| CPY | — | — | 16.88 | — | — | — | 16.88 | — |
| CPK | — | — | — | 12.50 | — | — | — | 12.50 |
| DPGDA | 6.34 | 5.74 | 5.69 | 4.11 | — | — | — | — |
| PG400DA | 10.00 | 10.00 | 10.00 | 15.00 | 1.34 | 0.74 | 0.69 | 4.11 |
| CN435 | 7.50 | 5.00 | 10.00 | — | 7.50 | 5.00 | 10.00 | — |
| IDA | 15.00 | 15.00 | 15.00 | 15.00 | 15.00 | 15.00 | 15.00 | 15.00 |
| IBOA | 30.00 | 30.00 | 30.00 | 30.00 | 45.00 | 45.00 | 45.00 | 45.00 |
| EPD | 2.50 | 2.50 | 2.50 | 2.50 | 2.50 | 2.50 | 2.50 | 2.50 |
| ITX | 5.00 | 5.00 | 5.00 | 5.00 | 5.00 | 5.00 | 5.00 | 5.00 |
| I907 | 4.00 | 4.00 | 4.00 | 5.00 | 4.00 | 4.00 | 4.00 | 5.00 |
| I379 | — | — | — | 1.00 | — | — | — | 1.00 |
| Byk ™ UV 3510 | 0.10 | 0.10 | 0.10 | 0.10 | 0.10 | 0.10 | 0.10 | 0.10 |
| INHIB | 0.81 | 0.78 | 0.83 | 0.79 | 0.81 | 0.78 | 0.83 | 0.79 |

All the inkjet inks had a viscosity of no more than 10.6 mPa·s and a surface tension between 24.0 and 25.0 mN/m.

Evaluation and Results

Samples of a technical image containing squares of different optical density in cyan, magenta, yellow, black, red, green and blue were printed on an: Anapurna™ printer from AGFA GRAPHICS using the above UV curable inkjet ink sets 1 to 4 on a PP substrate and on a PP substrate provided with a 30 μm thick cured layer of the UV curable primers P-2 to P-6. The comparative samples COMP-1 to COMP-15 and the inventive samples INV-1 to INV-9 according to Table 13 were obtained.

TABLE 13

| | Primer | | Inkjet inks | |
|---|---|---|---|---|
| Sample | Type | wt % monofunctional monomers | Type | wt % monofunctional monomers |
| COMP-1 | — | — | CMYK-1 | 15 |
| COMP-2 | | — | CMYK-2 | 30 |
| COMP-3 | | — | CMYK-3 | 45 |
| COMP-4 | | — | CMYK-4 | 60 |
| COMP-5 | P-2 | 62 | CMYK-1 | 15 |
| INV-1 | | 62 | CMYK-2 | 30 |
| INV-2 | | 62 | CMYK-3 | 45 |
| INV-3 | | 62 | CMYK-4 | 60 |
| COMP-6 | P-3 | 52 | CMYK-1 | 15 |
| INV-4 | | 52 | CMYK-2 | 30 |
| INV-5 | | 52 | CMYK-3 | 45 |
| INV-6 | | 52 | CMYK-4 | 60 |
| COMP-7 | P-4 | 42 | CMYK-1 | 15 |
| INV-7 | | 42 | CMYK-2 | 30 |
| INV-8 | | 42 | CMYK-3 | 45 |
| INV-9 | | 42 | CMYK-4 | 60 |
| COMP-8 | P-5 | 27 | CMYK-1 | 15 |
| COMP-9 | | 27 | CMYK-2 | 30 |
| COMP-10 | | 27 | CMYK-3 | 45 |
| COMP-11 | | 27 | CMYK-4 | 60 |
| COMP-12 | P-6 | — | CMYK-1 | 15 |
| COMP-13 | | — | CMYK-2 | 30 |
| COMP-14 | | — | CMYK-3 | 45 |
| COMP-15 | | — | CMYK-4 | 60 |

The flexibility and the pencil hardness were determined for each of the samples. The light fading and the flaking off was determined after treating it for 3 respectively 5 weeks in a Ci4000 Weather-Ometer™ from Atlas Material Testing Technology. The obtained results are shown in Table 14

TABLE 14

| Sample | Flaking off | Light Fading | Flexibility | Pencil Hardness |
|---|---|---|---|---|
| COMP-1 | 3 | 3 | 3 | 3 |
| COMP-2 | 3 | 3 | 1 | 3 |
| COMP-3 | 3 | 2 | 1 | 4 |
| COMP-4 | 2 | 2 | 1 | 4 |
| COMP-5 | 2 | 3 | 2 | 2 |
| INV-1 | 1 | 1 | 1 | 2 |
| INV-2 | 1 | 1 | 1 | 2 |
| INV-3 | 1 | 1 | 1 | 2 |
| COMP-6 | 2 | 3 | 3 | 2 |
| INV-4 | 1 | 1 | 1 | 1 |
| INV-5 | 1 | 1 | 1 | 2 |
| INV-6 | 1 | 1 | 1 | 2 |
| COMP-7 | 2 | 3 | 3 | 2 |
| INV-7 | 1 | 2 | 1 | 2 |
| INV-8 | 1 | 1 | 1 | 2 |
| INV-9 | 1 | 1 | 1 | 2 |
| COMP-8 | 2 | 3 | 3 | 2 |
| COMP-9 | 2 | 2 | 3 | 2 |
| COMP-10 | 2 | 2 | 1 | 2 |

TABLE 14-continued

| Sample | Flaking off | Light Fading | Flexibility | Pencil Hardness |
|---|---|---|---|---|
| COMP-11 | 2 | 1 | 1 | 2 |
| COMP-12 | 3 | 3 | 3 | 2 |
| COMP-13 | 2 | 3 | 3 | 2 |
| COMP-14 | 2 | 2 | 3 | 2 |
| COMP-15 | 2 | 2 | 3 | 2 |

From Table 14, it should be clear that only the samples INV-1 to INV-9 obtained excellent results for weather resistance, flexibility, and pencil hardness.

Exactly the same experiment was repeated in three experiments except that the yellow pigment PY150 was replaced by PY151, PY155 and PY180. For light fading very similar results were obtained with PY180 compared to PY150, while the light fading results were markedly better with PY151 and especially PY155.

The invention claimed is:

1. An inkjet printing method for producing images, the method comprising the steps of:

inkjet printing on a substrate a UV curable colorless primer including monofunctional monomers in a range of 40 wt % to 65 wt % based on a total weight of the UV curable colorless primer;

at least partially UV curing the inkjet printed UV curable colorless primer; and inkjet printing on the at least partially UV cured UV curable colorless primer one or more UV curable color inkjet inks, each of the one or more UV curable color inkjet inks including monofunctional monomers in a range of 30 wt % to 60 wt % based on a total weight of the respective UV curable color inkjet ink; wherein a ratio of the wt % of the monofunctional monomers in the UV curable colorless primer to the wt % of the monofunctional monomers in the one or more UV curable color inkjet inks is between 0.65 and 2.10.

2. The inkjet printing method according to claim 1, wherein an absolute difference in wt % of the monofunctional monomers in the UV curable colorless primer and the wt % of the monofunctional monomers in the one or more UV curable color inkjet inks is at least 8 wt %.

3. The inkjet printing method according to claim 1, wherein the monofunctional monomers in the UV curable colorless primer consist of monoacrylates.

4. The inkjet printing method according to claim 1, wherein the monofunctional monomers in the one or more UV curable color inkjet inks consist of monoacrylates.

5. The inkjet printing method according to claim 1, wherein the UV curable colorless primer and the one or more UV curable color inkjet inks are free radical curable compositions.

6. The inkjet printing method according to claim 1, wherein the UV curable colorless primer includes more than 6 wt % of a phosphineoxide type photoinitiator.

7. The inkjet printing method according to claim 6, wherein the phosphineoxide type photoinitiator is 2,4,6-trimethylbenzoyl-diphenyl-phosphineoxide.

8. The inkjet printing method according to claim 1, wherein the one or more UV curable color inkjet inks includes a UV curable yellow inkjet ink including a pigment selected from the group consisting of C.I Pigment Yellow 150, C.I Pigment Yellow 151, C.I Pigment Yellow 155, and C.I Pigment Yellow 180.

9. The inkjet printing method according to claim 8, wherein the pigment is C.I. Pigment Yellow 155.

10. The inkjet printing method according to claim 1, wherein the UV curable colorless primer includes no thioxanthone type photoinitiator.

11. The inkjet printing method according to claim 1, wherein a surface tension of the UV curable colorless primer is at least 2 mN/m larger than a surface tension of the one or more UV curable color inkjet inks.

12. The inkjet printing method according claim 1, wherein the one or more UV curable color inkjet inks include a plurality of UV curable color inkjet inks defining a UV curable CMYK inkjet ink set.

13. An article comprising:

an image obtained by the inkjet printing method according to claim 1.

14. The article of claim 13, wherein the article is selected from the group consisting of signage, billboards, banners, exhibition panels, construction announcements, and ad panels.

* * * * *